US006944992B2

(12) United States Patent
Brochu

(10) Patent No.: US 6,944,992 B2
(45) Date of Patent: Sep. 20, 2005

(54) GUTTER SHIELD

(76) Inventor: Stéphane Brochu, 890 Beaulieu St., St-Jean-Chrysostome, Quebec (CA), G6Z 2L1

( * ) Notice: Subject to any disclaimer, the term of this patent is extended or adjusted under 35 U.S.C. 154(b) by 0 days.

(21) Appl. No.: 10/780,198

(22) Filed: Feb. 17, 2004

(65) Prior Publication Data

US 2004/0187394 A1 Sep. 30, 2004

Related U.S. Application Data

(63) Continuation-in-part of application No. 10/017,330, filed on Dec. 14, 2001, now abandoned.

(51) Int. Cl.[7] ..... E04D 13/76
(52) U.S. Cl. ..... 52/12; 52/11; 248/48.1
(58) Field of Search ..... 52/11, 12; 210/474; 248/48.1, 48.2

(56) References Cited

U.S. PATENT DOCUMENTS

| | | | | | |
|---|---|---|---|---|---|
| 2,672,832 | A | * | 3/1954 | Goetz | 52/12 |
| 3,333,803 | A | * | 8/1967 | Landis | 248/48.2 |
| 4,553,356 | A | * | 11/1985 | Pepper | 52/11 |
| 4,750,300 | A | * | 6/1988 | Winger, Jr. | 52/12 |
| 5,842,311 | A | * | 12/1998 | Morin | 52/12 |

* cited by examiner

*Primary Examiner*—Carl D. Friedman
*Assistant Examiner*—Chi Q. Nguyen
(74) *Attorney, Agent, or Firm*—Eric Fincham

(57) ABSTRACT

A gutter shield for protecting a gutter from the gutter shield having a mounting member secured to the gutter, a guard member with an elongated configuration and having a plurality of apertures extending therethrough to permit water drainage into the gutter, the mounting member also having a flexible sealing element extending outwardly therefrom, the flexible ceiling element being designed to seal against either the side of the gutter or a structural element. The device is suitable for many different sizes of gutters.

14 Claims, 4 Drawing Sheets

GUTTER SHIELD

The present application is a continuation-in-part of application Ser. No. 10/017,330 filed Dec. 14, 2001 now abandoned.

FIELD OF THE INVENTION

The present invention relates to a shield for a rainwater gutter assembly or a eaves trough.

BACKGROUND OF THE INVENTION

The use of shields for gutters or eaves troughs is well known in the prior art and there have been many proposals for different types of shields. The purpose of the shield is essentially to permit passage of rainwater from the roof to the eaves trough while protecting the same from extraneous foreign matter such as leaves and the like.

To date, there have been several different approaches taken. A first approach is utilizing a shield or a guard which is apertured and permits the passage of rainwater while ostensibly barring the passage of extraneous material. However, many of these guards do not function as desired and access must still be had to the eaves trough for cleaning purposes. Also, each one must be fabricated to the particular size of eaves trough.

It has also been proposed in the art to provide relatively complex structures wherein the eaves troughs are mounted for rotatable movement such that they may be emptied at desired intervals.

There have also been proposed gutters having a design wherein a cover has an outer edge which curls downwardly and the water flow follows the curved portion due to surface tension to cascade into the eaves trough. However, this concept will not necessarily work when the volume of water becomes sufficiently large that the surface tension is insufficient to cause all the water to flow into the gutter.

SUMMARY OF THE INVENTION

It is an object of the present invention to provide a novel gutter guard which is designed to fit different sizes of eaves troughs.

It is a further object of the present invention to provide a gutter guard for an eaves trough forwarding the rainwater into the gutter, but wherein virtually all foreign matter is excluded.

It is a further object of the present invention to provide a gutter guard for an eaves trough wherein the gutter guard includes a flexible member design to sealingly abut an adjacent structure.

According to one aspect of the present invention, there is provided a device for protecting a gutter wherein the gutter has a rear wall, a front wall, a bottom wall, the walls defining a trough therebetween, the device comprising a mounting member, means for securing the mounting member to the gutter, a guard member having an elongated configuration with first and second longitudinally extending post sides, a first side of the guard member being engageable with a first side of the mounting member to prevent substantial vertical movement of the guard member, the mounting member having a flexible sealing portion extending outwardly in a direction away from the first side of the mounting member for sealing engagement with an adjacent structure, and the guard member having a substantially planar portion between the first and second sides, the substantially planar portion having a plurality of apertures extending therethrough.

The device of the present invention is preferably, at least partially, formed of a plastic material. However, it will be understood that other materials may be used and indeed, the gutter guard may be formed by a combination of materials.

The device of the present invention provides a guard for the eaves trough to prevent foreign matter from entering into the eaves trough. This is achieved through appropriate sizing of the apertures formed therein. In this respect, the aperture size and aperture placement permit adequate drainage of the water through the apertures into the eaves trough while substantially excluding any foreign matter which rained on the top and which normally will be removed by the elements of wind and the like. The size of the apertures prevents clogging of the device.

The apertures preferably extend in diagonal lines at an angle of 45° with respect to the gutter length. In the preferred embodiments, the apertures have an aperture of between 2.5 and 10 mm and even more preferably between 3.0 and 4.0 mm. As the apertures are arranged in diagonal rows, they are also preferably arranged in longitudinally extending rows. In a longitudinally extending row, the apertures are spaced apart by a distance of between 10 and 15 mm while in a diagonal row, they are spaced apart by a distance of between 5 and 10 mm.

As will be appreciated, during a period of heavy rain or the like, the drainage may not be instantaneous and accordingly, there is preferably provided a vertically extending wall adjacent the front wall of the gutter to prevent overflow.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
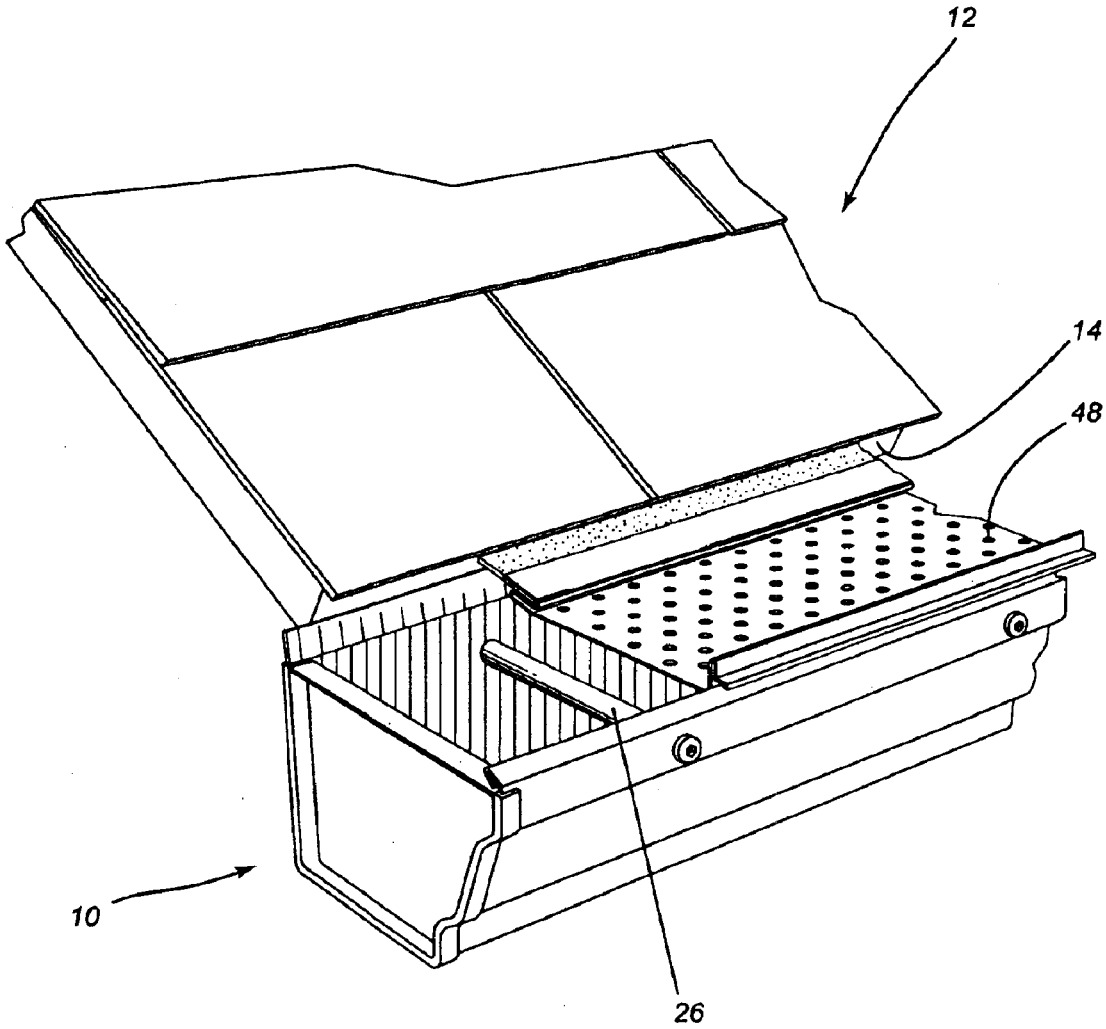
FIG. 1 is a perspective view of a portion of an eaves trough and surrounding structure having the gutter guard of the present invention secured in place.

Referring to the drawings in greater detail and by reference characters thereto, it is illustrated a gutter generally designated by reference numeral 10 and which is attached to a roof generally designated by reference numeral 12. As is conventional, there is provided a drip edge 14 extending from under the edge of the roof.

Gutter 10 is a conventional gutter and includes a back wall 16 lying substantially adjacent to the facia of the structure. Extending between a front wall 20 and back wall 16 is a bottom 18. Front wall 20 includes a front top wall 22 which extends horizontally inwardly and which is folded under to present a finished edge as is conventional. Gutter 10 is secured by means of nails 24 which pass through an internal shroud 26, again as is well known in the art.

The device of the present invention includes a mounting member generally designated by reference numeral 30 and which will now be referred to. Mounting member 30 has a base 32 which extends through to an end wall 34. In turn, end wall 34 merges with a top wall 36 which terminates in a downwardly extending flange 38. A recess 40 is defined between flange 38 and walls 32, 34 and 36. A flexible sealing member 42 extends outwardly to seal against drip edge 14.

The device also includes a second member 44 which includes a main planar body portion 46 which has a plurality of apertures 48 formed therein. Apertures 48, as may be seen, extend in diagonal lines at an angle of 45 degrees with respect to the length of the body 46. For a best functioning of the device, the sizing and placement of the apertures is important. The apertures preferably have a diameter of between 2.5 and 10 mm and more preferably between 3.0 and 4.0 mm. Also, the spacing is preferably such that in a longitudinally extending row, the apertures are spaced between 10 and 15 mm apart with a spacing of between 5 and 10 mm in a diagonal row. It has been found that these spacings and sizes of apertures permit water to flow into the gutter while the sizes are such that substantially all foreign matter is excluded.

The second member 44 includes a flange 50 which extends inwardly along one side of body 46 for reasons which will become apparent hereinbelow. Flange 50, together with body portion 46, defines a V-shaped configuration.

At its other side, body 46 has a vertical inner wall 52 which is radiused to join a vertical outer wall 54. A horizontal portion 56 extends outwardly from vertical outer wall 54 and terminates in a reverse edge.

Figure 4:
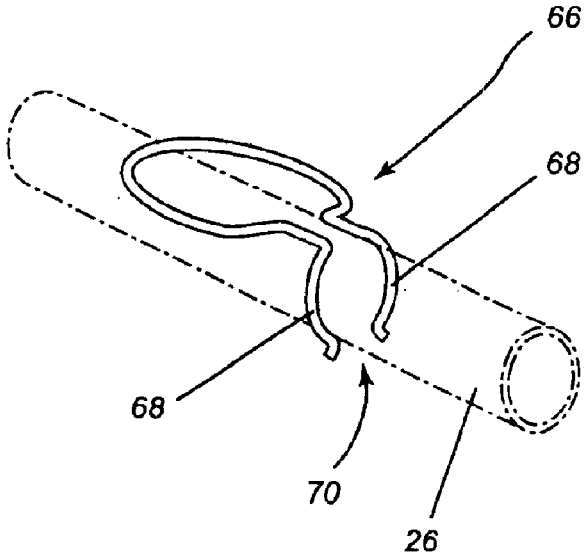
FIG. 4 is an enlarged view of a clip member which may be used in the present invention.

In use, first member 30 is secured adjacent rear wall 16 of gutter 10. To this end, there are provided clip members 66 which are secured to the underside of wall 32 of first member 30. In one embodiment, as shown in FIG. 4, each clip member 66 comprises a pair of inwardly facing C-shaped elements 68 defining an opening 70 therebetween. These are then mounted on shroud 26 surrounding a nail 24.

As may be seen in FIG. 4, the end of body 46 having flange 50 may be inserted into the cavity 42. Flange 50 will prevent withdrawal of second member 44.

Vertical inner side wall 52 forms a barrier to prevent overflow of the rainwater from the surface of body portion 46.

Figure 2:
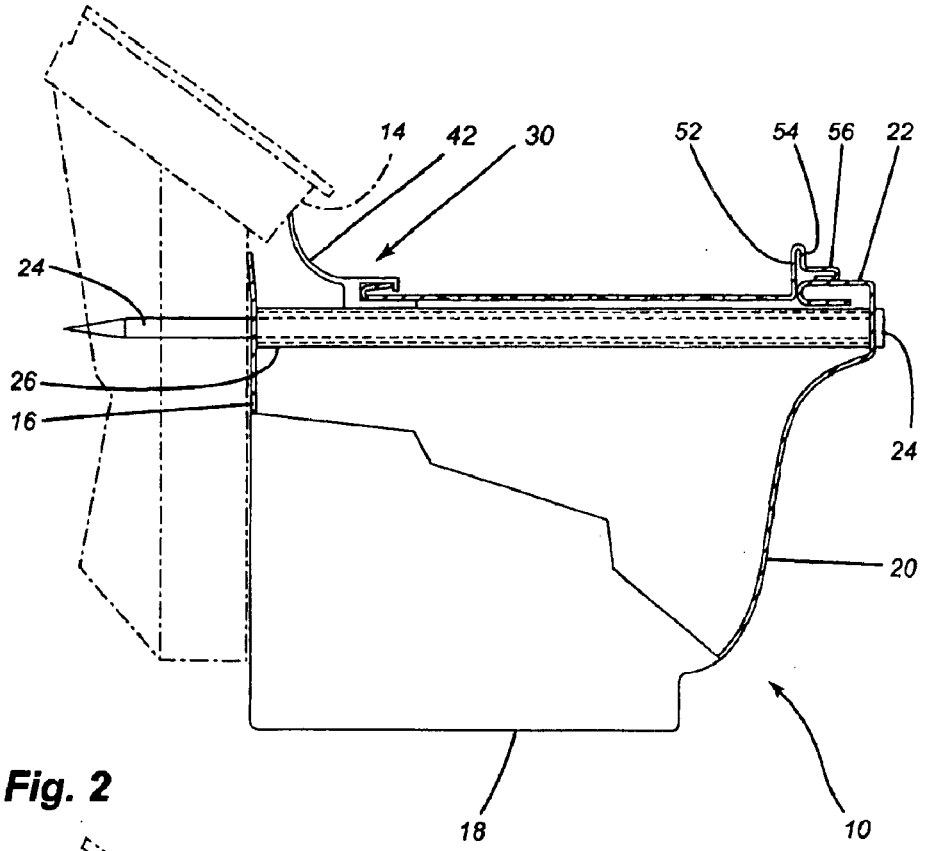
FIG. 2 is a cross sectional view thereof.
Figure 2A:
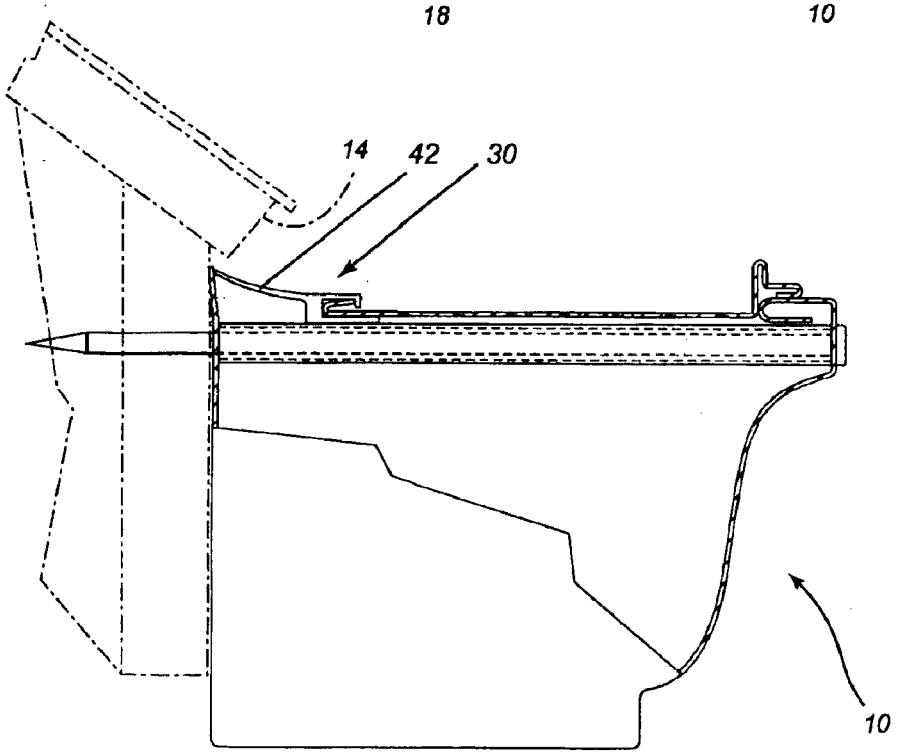
FIG. 2*a* is a cross sectional view of a modified arrangement.
Figure 3:
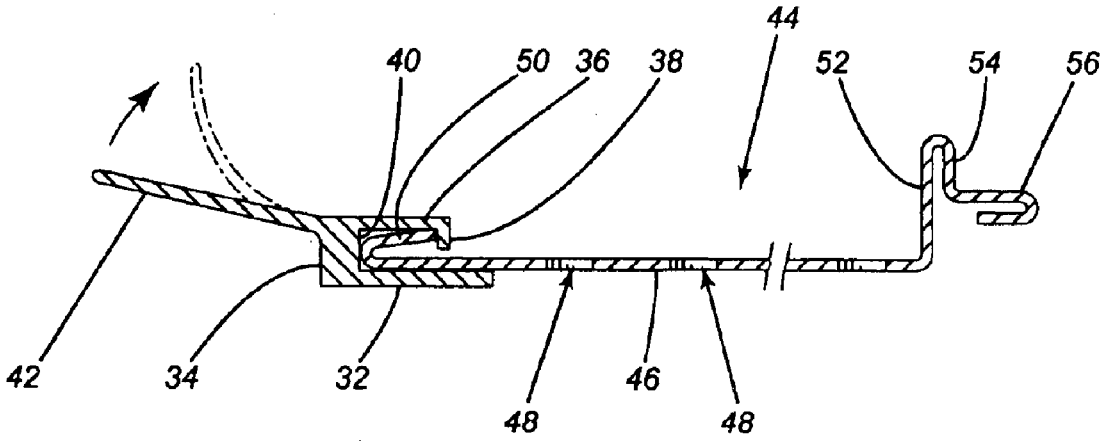
FIG. 3 is a cross sectional view of the gutter guard.

As seen in FIG. 2*a*, flexible sealing member may seal against the wall to which the gutter is mounted or indeed to the gutter itself. It is the flexibility of sealing member 42 which allows adjustment of the gutter guard to fit different size gutters.

Figure 5:
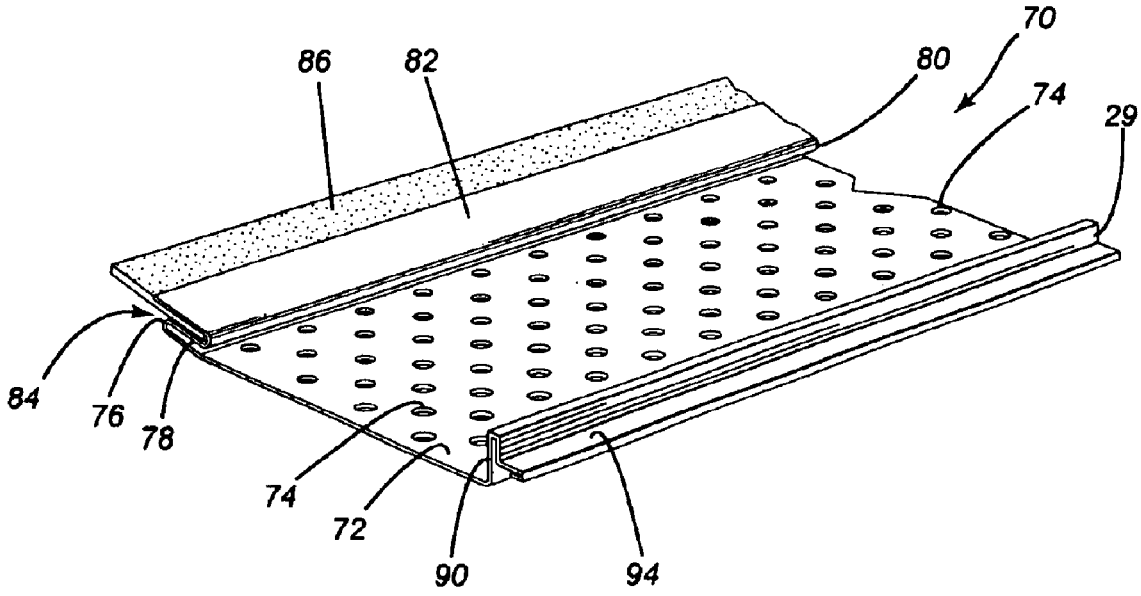
FIG. 5 is a perspective view of a portion of a further embodiment of a gutter guard.

Turning to FIG. 5, there is illustrated a further embodiment of the invention. In this arrangement, there is provided a gutter guard generally designated by reference numeral 70 and which includes a main planar body portion 72. Provided in main planar body portion 72 are a plurality of apertures 74 which, as in the previously described embodiment, preferably have a diameter of between 0.5 and 10 mm with the apertures extending in diagonal rows.

At a first side of main planar body portion 72, there is provided a first bight 76 followed by a inwardly extending wall 78. Inwardly extending wall 78 in turn terminates in a second bight 80 followed by an outwardly extending wall 82. Walls 78 and 82 define therebetween a channel 84 which is designed to receive a sealing member 86 which functions in a manner similar to the previously described sealing member 42.

At its other side, main planar central portion 72 terminates in a vertical outer wall 90 which is radiused to join a vertical outer wall 92. A horizontal portion 94 extends outwardly from vertical outer wall 92 and terminates in a reverse edge in a manner similar to the previously described embodiment.

It will be understood that the above described embodiment is for purposes of illustration only and that changes or modifications may be made thereto without departing from the spirit and scope of the invention.

I claim:

1. A device for protecting a gutter wherein the gutter has a rear wall, a front wall, a bottom wall, said walls defining a trough therebetween, said device comprising:

a mounting member and means for securing said mounting member to said gutter; said means for securing said mounting member to said gutter comprising a clip member having a pair of legs extending downwardly and being designed to be attached to a gutter retaining member extending between said rear side wall and said front wall.

a guard member having an elongated configuration with first and second longitudinally extending sides;

a first side of said guard member being engageable with a first side of said mounting member to prevent substantial vertical movement of said guard member;

said mounting member having a flexible sealing portion extending outwardly in a direction away from said first side of said mounting member for sealing engagement with an adjacent structure; and said guard member having a substantially planar portion between said first and second sides, said substantially planar portion having a plurality of apertures extending therethrough.

2. The device of claim 1 wherein said apertures are arranged in diagonal rows extending between said rear side wall and said front wall.

3. The device of claim 1 wherein said apertures are circular in configuration, said apertures having a diameter of between 2.5 and 10 mm.

4. The device of claim 3 wherein said apertures have a diameter of between 3.0 and 4.0 mm.

5. The device of claim 3 wherein said diagonal rows extend at an angle of 45° with respect to said first and second side walls, said apertures forming longitudinally extending rows, said apertures being spaced apart by a distance of between 10 and 15 mm in said longitudinally extending rows.

6. The device of claim 5 wherein said apertures are spaced apart by between 5 and 10 mm in each diagonal row.

7. The device of claim 1 wherein said mounting member has a recess facing said first side of said guard member whereby said first side of said guard member is insertable into said recess and is moveable therein.

8. The device of claim 7 wherein said mounting member has means for retaining said first side of said guard member in said recess.

9. The device of claim 8 wherein said means for retaining said first side comprises a V-shaped member formed within said recess and a cooperating V-shaped member formed on said one side of said guard member.

10. The device of claim 1 wherein said guard member has a vertically extending side wall adjacent said second side thereof.

11. In combination, a gutter and a gutter shield device, said gutter having a rear wall, a front wall, and a bottom wall, said rear wall and bottom wall defining an open end trough, said gutter having a gutter retaining member extending between said front and rear walls for securement to a structure, said gutter shield device comprising:

a mounting member, means for securing said mounting member to said gutter retaining member, said means for securing said mounting member to said gutter comprising a clip member having a pair of legs extending downwardly and about said gutter retaining member;

a guard member having an elongated configuration with first and second longitudinally extending sides;

a first side of said guard member being engageable with a first side of said mounting member to prevent substantial movement of said guard member;

said mounting member having a flexible sealing portion extending outwardly in a direction away from said first side of said mounting member for sealing engagement with the structure; and said guard member having a substantially planar portion between said first and second sides, said substantially planar portion having a plurality of apertures extending therethrough.

12. The combination of claim 11 wherein said mounting member has a recess facing said first side of said gutter member whereby said first side of said guard member is insertable into said recess and is moveable therein.

13. The device of claim 11 wherein said guard member has a vertically extending side wall adjacent said second side thereof.

14. A device for protecting a gutter wherein the gutter has a rear wall, a front wall, and a bottom wall, said walls defining a trough therebetween, said device comprising:

a mounting member, means for securing said mounting member to said gutter;

a guard member having an elongated configuration with first and second longitudinally extending sides;

a first side of said guard member having a channel extending there along;

said guard member having a substantially planar portion between said first and second sides, said substantially planar portion having a plurality of apertures extending therethrough; and a flexible sealing portion extending outwardly in a direction away from said first side of said guard member for sealing engagement with an adjacent structure, said scaling member being retained within said channel formed at said first side of said guard member.

* * * * *